United States Patent [19]

Kandpal et al.

[11] Patent Number: 5,022,833

[45] Date of Patent: Jun. 11, 1991

[54] SINGLE PIECE GASKET VALVE PLATE ASSEMBLY

[75] Inventors: Tara C. Kandpal, Tecumseh; Andrew W. Paczuski, Adrian, both of Mich.; Herbert G. Siewert, Sylvania, Ohio

[73] Assignee: Tecumseh Products Company, Tecumseh, Mich.

[21] Appl. No.: 446,648

[22] Filed: Dec. 6, 1989

[51] Int. Cl.[5] ..... F04B 39/10; F04B 21/02

[52] U.S. Cl. ..... 417/571; 277/235 B

[58] Field of Search ..... 417/571, 569, 570, 454, 417/563, 564; 277/235 B, 236; 92/60.5, 73, 171.5

[56] References Cited

U.S. PATENT DOCUMENTS

| | | | |
|---|---|---|---|
| 3,352,564 | 11/1967 | Johnson | 277/235 B |
| 3,396,903 | 8/1968 | Oya . | |
| 3,509,907 | 5/1970 | Gannaway | 417/571 |
| 4,115,044 | 9/1978 | Gannaway | 417/564 |
| 4,203,608 | 5/1980 | Nicholson | 277/236 |
| 4,385,872 | 5/1983 | Anderson | 417/559 |
| 4,408,967 | 10/1983 | Unger et al. | 417/571 |
| 4,537,566 | 8/1985 | Blass et al. | 417/569 |
| 4,635,949 | 1/1987 | Lucas et al. | 277/235 B |
| 4,721,443 | 1/1988 | Allen | 417/559 |
| 4,810,591 | 3/1989 | Sakai | 277/236 |

*Primary Examiner*—Leonard E. Smith
*Assistant Examiner*—David L. Cavanaugh
*Attorney, Agent, or Firm*—Jeffers, Hoffman & Niewyk

[57] ABSTRACT

A single piece gasket valve plate assembly for sealing and separating assembly parts secured to the valve plate of a reciprocating piston compressor. The gasket includes a compressible peripheral portion for sealing and separating the valve plate to the cylinder head. The device also includes compressible central portions, which are spaced from and integral with the peripheral portion, wherein the central portions members are adapted to encircle the suction ports of the valve plate to seal and separate the suction ports from the discharge ports. A connecting portion extending through the discharge chamber connects the peripheral portion of the gasket to the central portions.

11 Claims, 3 Drawing Sheets

SINGLE PIECE GASKET VALVE PLATE ASSEMBLY

BACKGROUND OF THE INVENTION

This invention relates to a hermetic reciprocating piston compressor, and in particular to a compressor having a single piece gasket valve plate assembly associated therewith.

Reciprocating compressors generally use a unitary valve plate to cover all the cylinders of the compressor. The valve plate includes a suction port and discharge port, which are respectively in fluid communication with a suction pressure chamber and a discharge pressure chamber of a cylinder head. Such valve plates are generally sealed to the cylinder head of a compressor by means of several gaskets. For example, in a dual piston assembly, three gaskets are used: one outer gasket to seal the periphery of the valve plate to the cylinder head, and two inner ring gaskets to seal each cylinder suction valve area to its corresponding suction chamber.

Valve plates and cylinder head assemblies have become relatively complex for certain compressors and can be quite costly to assemble and manufacture. Therefore, it is important to reduce the number of steps needed to assemble these compressors.

The use of multiple valve plate gaskets in compressors has been effective to seal and separate assembly parts. Notwithstanding this success, efforts are continuously directed toward increasing the rate of compressor assembly production. Considerations of manufacturability and costs impact on the desirability of the aforementioned prior art gaskets. For example, during initial manufacturing of the compressor assembly, the outer gasket must be installed independently of the inner ring gaskets. In addition, the inner ring gaskets may get out of proper alignment with the valve plate during assembly, especially during very high rates of automated production. Furthermore, the ring gaskets may adhere together during production resulting in two ring gaskets in the place where only one should be. Consequently, the next valve plate on the assembly line may have no gasket installed therein.

Thus, not only does the present use of multi-piece gaskets result in a greater time of manufacture and assembly, but may also result in the assembly of compressors with an improper number or placement of the separate gaskets.

SUMMARY OF THE INVENTION

The problems and disadvantages of the aforementioned compressor valve plate assembly having multiple gaskets are overcome by the present invention wherein a single, unitary gasket is secured to the valve plate assembly to provide all necessary sealing of the head to the valve plate during assembly of the compressor. More particularly, the invention provides a single, unitary gasket which seals the cylinder head to the valve plate, and simultaneously seals and separates the suction chamber from the discharge chamber.

The invention further provides a method of assembly of a valve plate and gasket in a reciprocating piston compressor.

One advantage of the valve plate assembly according to the present invention is that one relatively large gasket is provided, which allows more consistent and reliable alignment with the valve plate.

Another advantage of the present invention is that the unitary gasket is larger than the separate ring gaskets of the prior art and, thus, are less likely to adhere together so that a single gasket is consistently provided for each valve plate.

A further advantage of the present invention is that only one manufacturing step is needed to install the gasket instead of two or more steps as required for the gaskets of the prior art. The elimination of the additional steps reduces assembly costs.

The present invention, in one form thereof, comprises a method for assembling a gasket and valve plate assembly. The compressor includes a crankcase with a top surface, two cylinder bores disposed in the crankcase and a piston located in each of the cylinder bores. A crankshaft drives the pistons. A cylinder head having a bottom surface is adapted to engage the top surface of the valve plate. In addition, the cylinder head includes two suction and discharge chambers for fluid communication of each chamber with its respective cylinder. A valve plate mounted on the top surface of the crankcase includes suction ports and discharge ports. The method of assembly comprises providing a unitary gasket having a peripheral portion, a central portion in spaced relationship with the peripheral portion, wherein each central portion is adapted to encircle one of the suction ports, and, two connecting portions preferably extending through the suction or discharge chambers to connect the peripheral portion to the two central portions. A discharge valve is mounted to the valve plate. The valve plate gasket is then aligned in registry with the valve plate so that the peripheral portion extends along the perimeter of the valve plate and the central portions encircle the suction ports. A discharge valve retainer is assembled to the plate, and the cylinder head is then mounted on the valve plate such that the unitary gasket seals and separates the cylinder head from the valve plate, and simultaneously seals and separates the suction chambers from the discharge chambers.

The present invention, in one form thereof, comprises a twin cylinder reciprocating piston compressor having a crankcase, two cylinder bores disposed in the crankcase, and a piston located in each of the bores. A crankshaft drives the pistons. There is also provided a cylinder head and a valve plate which is located between the crankcase and the cylinder head. The valve plate includes suction ports and discharge ports to provide fluid communication with the cylinder bores. A unitary valve plate gasket is located between the cylinder head and the valve plate. The gasket includes a compressible peripheral portion and two annular central portions, which are spaced from the peripheral portion, each adapted to encircle a suction port. Two correcting portions of the gasket preferably extend through the discharge or suction chambers to connect the peripheral portion with the two central portions.

It is an object of the present invention to provide a method for consistent and reliable placement of one or more gaskets on a valve plate assembly.

It is another object of the present invention to provide a unitary gasket that is less likely to adhere to other gaskets during automated assembly so that a single gasket is consistently available for sealing each valve plate.

Yet another object of the present invention is to reduce the number of manufacturing steps needed to attach several gaskets to the valve plate of a compressor.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
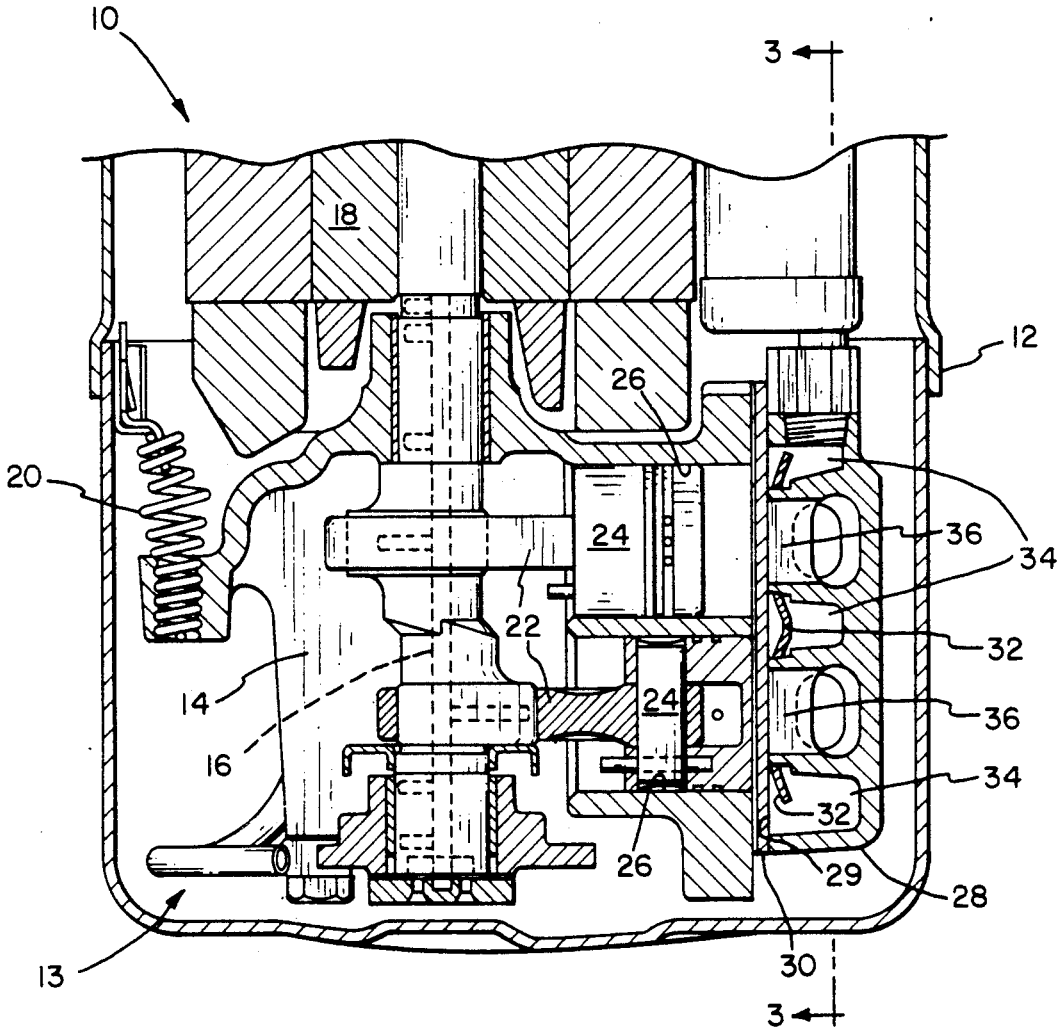
FIG. 1 is a partial cross-sectional view of a multiple cylinder reciprocating compressor, including a valve plate assembly in accordance with the present invention.

Referring to the drawings, and in particular to FIG. 1, there is shown a hermetically sealed, twin cylinder reciprocating piston compressor 10 of the type to which the present invention is applicable. Compressor 10 includes a sealed compressor housing 12 encapsulating the motor compressor unit 13. Disposed within housing 12 is a crankcase 14 supporting a crankshaft 16 which is driven by motor 18. Shock mounts 20 attached to crankcase 14 and housing 12 suspend the compressor components within housing 12.

By way of illustration, and without limitation, orientation of compressor 10 in the illustrated preferred embodiment is with crankcase 14 suspended vertically below motor 18. Crankshaft 16 within crankcase 14 drives connecting rods 22, which are in turn connected to pistons 24 within cylinders 26. Cylinders 26 extend through the top surface of crankcase 14.

A cylinder head 28 having a bottom surface 29 is assembled onto the top surface of crankcase 14 by means of bolts (not shown). A valve plate 30, to which discharge valves 78 are mounted (FIGS. 4 and 5), is interposed between cylinder head 28 and crankcase 14. FIG. 1 shows discharge valve retainer 32 as is well known in the prior art.

Figure 3:
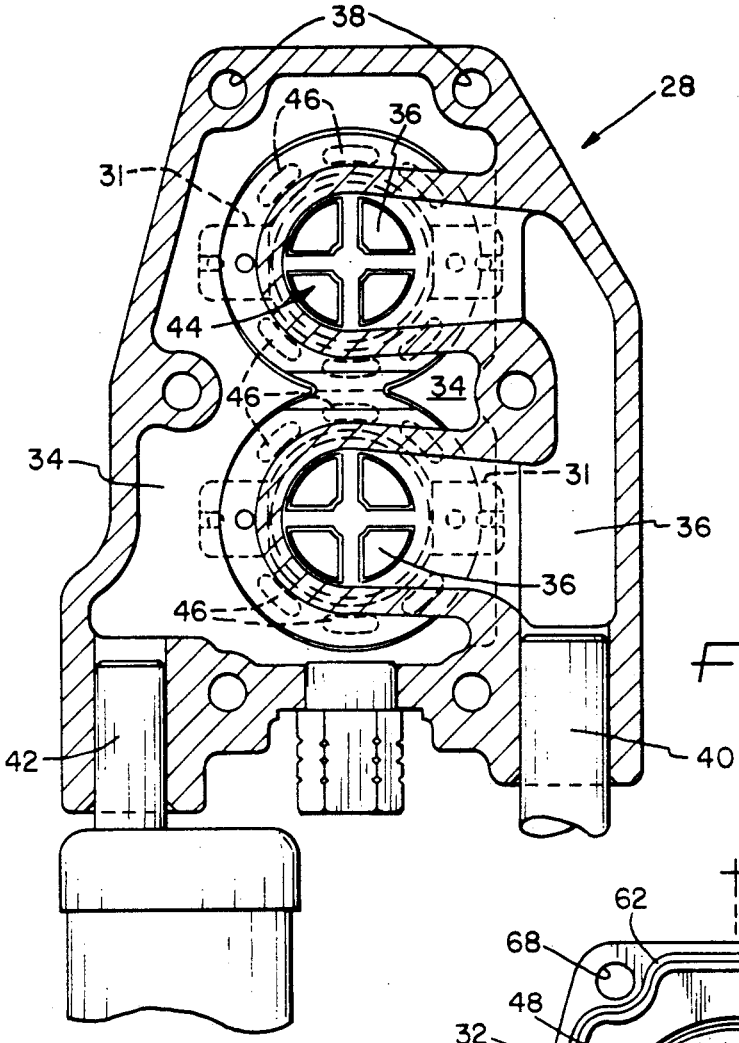
FIG. 3 is an enlarged fragmentary, sectional view of the compressor of FIG. 1, taken along line 3—3.

Cylinder head 28 includes discharge chamber 34 and suction chamber 36. During operation of compressor 10, the reciprocating action of pistons 24, together with discharge valves 78 and suction valves 31 mounted on valve plate 30, produce regions of discharge pressure and suction pressure in chambers 34 and 36, respectively. Referring to FIG. 3 for a more detailed description of cylinder head 28, there are shown multiple head bolt apertures 38, suction inlet 40 and discharge outlet 42. Also shown are centrally located suction ports 44 and discharge ports 46 spaced around suction ports 44 which are located substantially over cylinders 26 when compressor 10 is assembled. Conventional suction valves 31 and discharge valves 78 are attached to valve plate 30 in operative fashion. Valve plate 30 is preferably made of sintered metal, therefore enabling the forming of details without need for machining.

Figure 2:
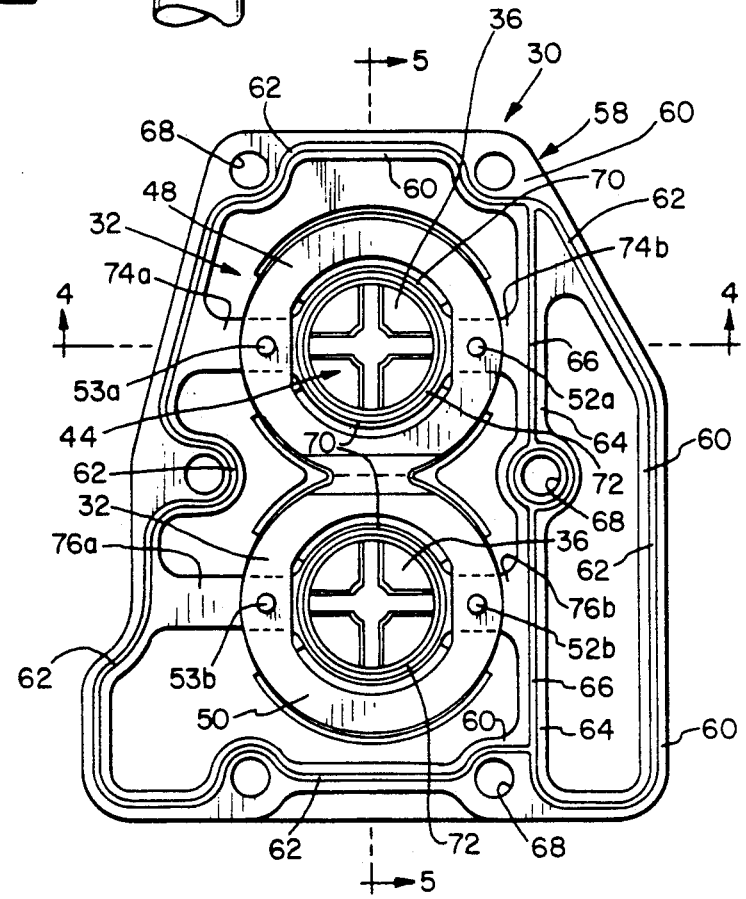
FIG. 2 is an enlarged plan view of the valve plate assembly for the compressor of FIG. 1.
Figure 5:
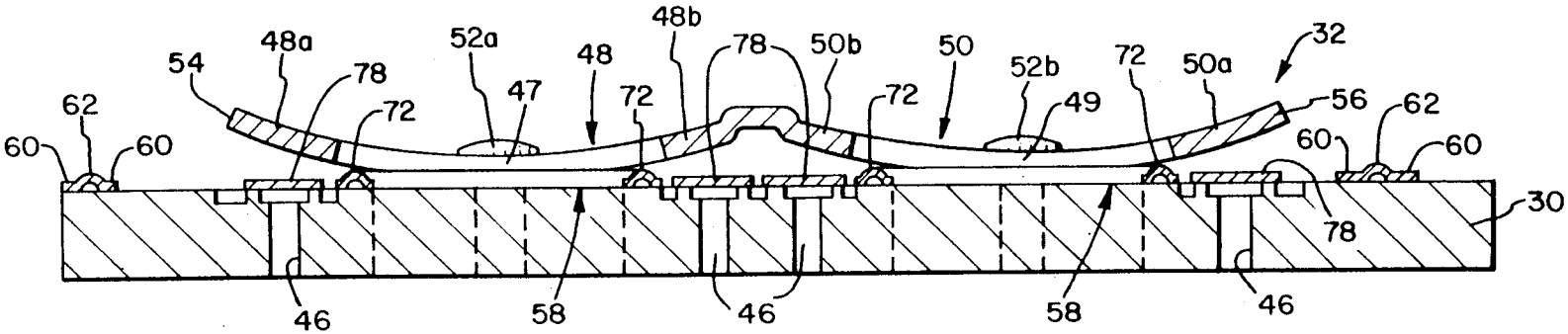
FIG. 5 is an enlarged cross-sectional view of the valve plate assembly of FIG. 2 taken along line 5—5.

FIGS. 2 and 5 illustrate valve retainer 32 including a first portion 48 and a second portion 50, both with generally annular shapes. Portions 48 and 50 are secured to valve plate 30 by rivets **52*a*, 52*b*, 53*a*, and 53*b*. Portions 48 and 50 include segments 48*a* and 48*b*, and 50*a* and 50*b*, which extend from riveted portions 47 and 49, respectively, and curve away from valve plate 30. Portions 48 and 50 terminate at ends 54 and 56. Located adjacent valve plate 30 are discharge valves 78, each associated with a discharge port 46**. U.S. Pat. No. 4,721,443, which is incorporated herein by reference, discloses the discharge valve structure in detail.

Referring to FIG. 2, a single unitary gasket 58 is shown and comprises a generally planar peripheral portion 60 including raised bead 62. In the preferred embodiment, gasket 58 has a 0.005 inch steel base with a 0.0025 inch Buna-N coating on each side. Gasket 58 further includes anchor leg portion 64, which is generally planar and includes raised bead 66. Apertures 68 are provided in both peripheral portion 60 and anchor leg portion 64 for alignment with head bolt holes 38 of valve plate 30.

Gasket 58 also includes inner rings 70 including a raised bead 72. Inner rings 70 encircle suction ports 44 to seal and separate fluid from suction chamber 36 and discharge chamber 34. Inner rings 70 are integral with peripheral portion 60 and anchor leg portion 64 by intermediate connecting portions **74*a*, 74*b* and 76*a*, 76*b*. Connecting portions 74*a* and 76*a* are integral with and respectively connected to respective diametrically opposed sides of peripheral portion 60 and inner rings 70. Similarly, connecting portions 74*b* and 76*b* are integral with and respectively connected to respective diametrically opposed sides of anchor leg portion 64 and inner rings 70**.

Figure 4:
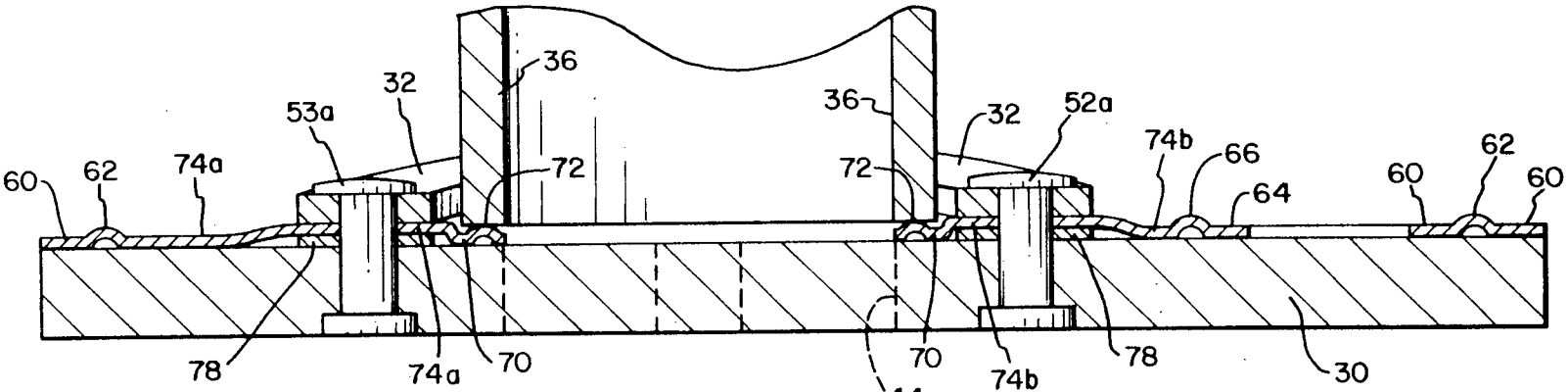
FIG. 4 is a cross-sectional view of the valve plate assembly of FIG. 2 taken along line 4—4.

As shown in FIG. 5, raised bead 72 seals discharge cavity 34 from the suction cavity 36. As shown in FIG. 4, inner ring 70 seals suction chamber 36 from discharge chamber 34. Discharge valve 78 is located beneath intermediate portion **74*b* of gasket 58. Resting on intermediate portion 74*b* is valve retainer 32. Rivets 52*a* and 53*a* extend through valve retainer 32, intermediate portion 74*b* of gasket 58, and discharge valve 78, thus securing gasket 58 to valve plate 30. The gasket inner ring portions 70 are offset to account for the thickness of discharge valves 78, which are disposed on the surface of valve plate 30. This prevents the inner ring portions 70 of the gasket from being reformed during assembly and riveting (FIG. 4**).

An important aspect of the present invention relates to a method of assembling the compressor using the unitary valve plate gasket. The method comprises the steps of locating the discharge valves 78 and aligning gasket 58 it in registry with valve plate 30 so that peripheral portion 60 extends along the perimeter of valve plate 30 and that inner rings 70 encircle suction ports 44. Valve retainer 32 is then aligned in registry around suction ports 44 such that the apertures (not shown) in valve retainer 32 are located over connecting portions **74*a*, 74*b* and 76*a*, 76*b*. Valve retainer 32 and gasket 58 are secured to valve plate 30 by any suitable means, such as rivets 52*a*, 52*b* and 53*a*, 53*b*. Thus, the valve plate 30, discharge valve 78, valve retainer 32 and gasket 58 can be assembled as a subassembly at a position off the main assembly line during production. It is also possible to preassemble the suction valve 31 to pins (not shown) extending downwardly from valve plate 30. The valve plate assembly 30 is attached to the top surface of crankcase 14. Cylinder head 28 is then mounted on valve plate 30 such that peripheral portion 60 of gasket 58 seals and separates valve plate 30 from cylinder head 28, and inner rings 70 seal and separate suction chamber 36 from discharge chamber 34**.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice to which the invention pertains and fall within the limits of the appended claims.

What is claimed is:

1. In a hermetic reciprocating compressor including a crankcase having a plurality of cylinder bores formed therein, a piston reciprocatingly disposed within each of said cylinder bores, a cylinder head defining a suction chamber and a discharge chamber, a value plate intermediate said crankcase and said cylinder head and having a respective suction port aligned with each cylinder bore and a plurality of groups of discharge ports in fluid communication with respective said cylinder bores, each said group of discharge ports comprising a plurality of discharge ports at least partially encircling a respective said suction port, discharge valves and respective discharge valve retainers mounted to said valve plate and associated with said discharge ports, a unitary valve plate gasket disposed between said cylinder head and said valve plate, said valve plate gasket comprising:

a compressible peripheral portion;

a plurality of annular central portions in spaced relationship with said peripheral portion, each said central portion encircling a respective one of said suction ports; and connecting portions extending from said peripheral portion to respective annular central portions to connect said peripheral portion to said central portions of said gasket, each said connecting portion extending between adjacent discharge ports in a respective said group thereof.

2. The compressor assembly of claim 1, wherein said valve plate gasket is comprised of a resilient material.

3. The compressor assembly of claim 1, wherein said valve plate gasket is comprised of steel and coated with a polymer.

4. The compressor assembly of claim 1, wherein said peripheral portion and said central portions each forms an unbroken loop.

5. The compressor assembly of claim 1, wherein said connecting portions are secured to said valve plate by a plurality of rivets.

6. The compressor assembly of claim 1, wherein said valve plate gasket includes an anchor leg portion, which is integral with said peripheral portion, and is integral with and interconnects said connecting portions and two opposed sides of said peripheral portion.

7. The compressor assembly of claim 1, wherein said peripheral portion has a plurality of apertures formed therein.

8. The compressor of claim 1 wherein said connecting portions extend through said discharge chamber.

9. The compressor of claim 1 including means extending through said retainers, discharge valves, gasket connecting portions and plate to fasten said valves, retainers, gasket and plate together.

10. A hermetic reciprocating compressor including a crankcase with a plurality of cylinder bores formed therein, a piston reciprocatingly disposed within each of the cylinder bores, a cylinder head defining a suction chamber and a discharge chamber, a valve plate intermediate said crankcase and said cylinder head, a plurality of central fluid ports in said plate aligned respectively with said cylinder bores, a plurality of groups of peripheral fluid ports in said plate generally aligned with respective said cylinder bores and at least partially encircling respective said central ports, and a unitary central valve plate gasket disposed between said cylinder head and said valve plate, said gasket comprising:

a compressible peripheral portion;

a plurality of annular central portions in spaced relationship with said peripheral portion, each said central portion being adapted to encircle a respective central port in said valve plate; and connecting portions extending from said peripheral portion to respective annular central portions to connect said peripheral portion to said central portions, said connecting portions extending between adjacent peripheral ports in a respective group thereof.

11. The compressor of claim 10 wherein said connecting portions extend through said discharge chamber.

* * * * *